United States Patent [19]

Clarke

[11] 3,995,523

[45] Dec. 7, 1976

[54] DEVICES FOR USE WITH STRINGED MUSICAL INSTRUMENTS

[76] Inventor: Amos Alexander Graham Clarke, 7 Wharf Close, Abingdon, Oxon, England

[22] Filed: July 16, 1975

[21] Appl. No.: 596,445

[30] Foreign Application Priority Data

July 18, 1974 United Kingdom ..... 31963/74

[52] U.S. Cl. ..... 84/317

[51] Int. Cl.[2] ..... G10D 3/08

[58] Field of Search ..... 84/315–319

[56] References Cited

UNITED STATES PATENTS

| | | | |
|---|---|---|---|
| 745,557 | 12/1903 | Baker | 84/315 |
| 1,785,311 | 12/1930 | Johnson | 84/317 |
| 2,669,151 | 2/1954 | Maccaferri | 84/317 |
| 3,776,088 | 12/1973 | Jones | 84/317 |
| 3,903,776 | 9/1975 | Owen | 84/318 |

*Primary Examiner*—Lawrence R. Franklin
*Attorney, Agent, or Firm*—Mason, Kolehmainen, Rathburn & Wyss

[57] ABSTRACT

A device for use in playing a stringed instrument comprises a base plate which is adapted to be fitted above the strings and which carries at least one pair of keys connected by a cross-bar by which both keys can be operated together to engage different strings or either key can be pressed against its own string only. There may also be other, individually operable keys.

9 Claims, 9 Drawing Figures

| | PLUCK ALL STRINGS | PLUCK STRINGS 1 TO 5 ONLY | | | | PLUCK STRINGS 1 TO 4 ONLY | | | |
|---|---|---|---|---|---|---|---|---|---|
| | 0 | 13 | 23 | 2 | 123 | 14 | 34 | 134 | 4 |
| | C | G7 | F | Am | Dm | E7 | Fm | A DIMINISHED CHORD | AN AUGMENTED CHORD |
| | G | D7 | C | Em | Am | B7 | Cm | | |
| | D | A7 | G | Bm | Em | F♯7 | Gm | | |
| | A | E7 | D | F♯m | Bm | C♯7 | Dm | | |
| | E | B7 | A | C♯m | F♯m | G♯7 | Am | | |
| | B | F♯7 | E | C♯m | C♯m | D♯7 | Em | | |
| | F♯ | C♯7 | B | D♯m | G♯m | A♯7 | Bm | | |

FIG.8.

DEVICES FOR USE WITH STRINGED MUSICAL INSTRUMENTS

This invention relates to a device for use with stringed instruments, especially guitars or other instruments of a similar nature.

The invention has for its principal object the provision of a device which can be fitted to such an instrument and which will facilitate its playing, especially in the playing of chords.

The invention provides a device for use when playing a stringed instrument comprising a base, which is adapted to be fitted to the instrument so as to extend over at least some of the strings of the latter, and a plurality of keys which are carried by the base in positions to engage strings of the instrument when the device is in position on the latter, wherein at least some of these keys are manually operable, being biased out of engagement with the strings but being adapted to be pressed against them by finger pressure, and wherein at least one pair of such keys are connected together by a cross-bar, pressure against which moves these keys against the strings for the playing of a chord or the notes individually.

The device may and preferably does have one or more (preferably at least two) fixed stops which press against strings when the device is fitted to the instrument, one or more individual movable keys which normally do not engage the strings but which can be pressed individually against the latter, one or more (preferably two) movable pairs of keys and a cross bar or bars connecting the keys of the or each pair such that pressure applied to the cross-bar operates the keys connected with it simultaneously. Preferably, according to this invention, it is also possible to operate one key only of a pair by pressing on one end of a cross-bar.

Further features of the invention and its use will be apparent from the following description of a preferred embodiment. A device (which may be referred to as a chord finder) for fitting to a six-stringed guitar will be described, although modifications in the arrangement and numbers of the keys and stops are possible, while the device could also be designed for use with other stringed instruments.

Reference will be made to the accompanying drawings, in which:

FIGS. 8 and 9 illustrate musically the use of the device.

Figure 1:
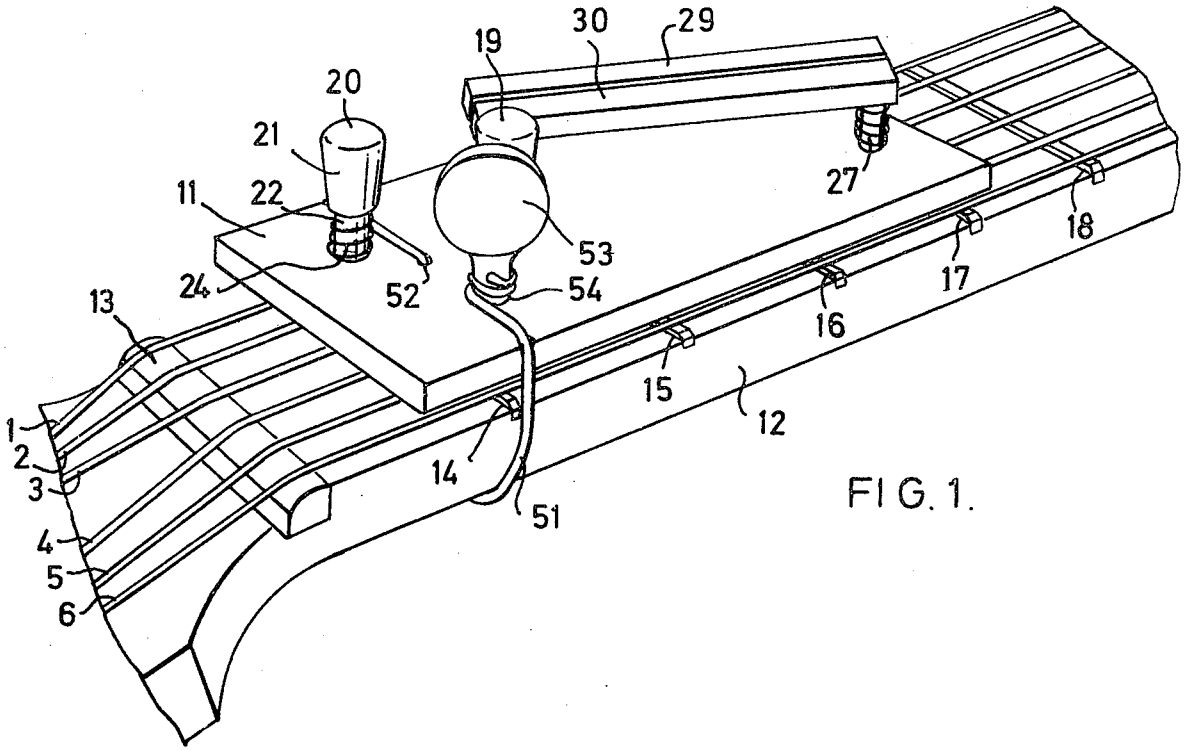
FIG. 1 is a general perspective view showing this device fitted to a guitar.
Figure 2:
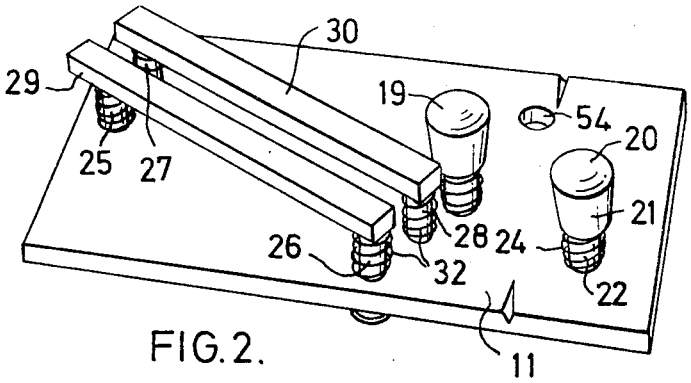
FIG. 2 is a perspective view showing a device similar to that shown in FIG. 1 except for some detail modifications and for the omission of the means for securing it to the instrument.
Figure 3:
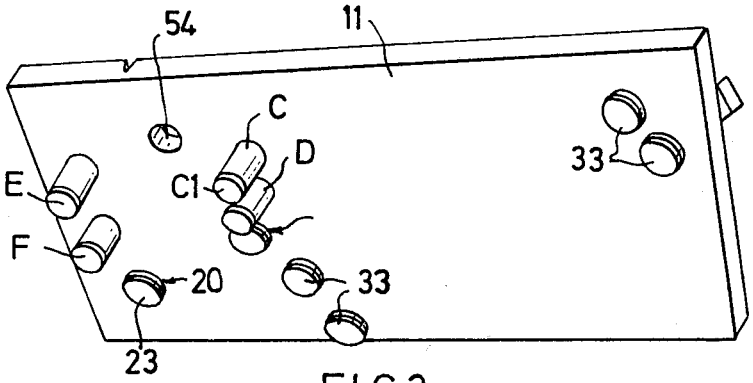
FIG. 3 is an underneath perspective view of the device shown in FIG. 2.
Figure 4:
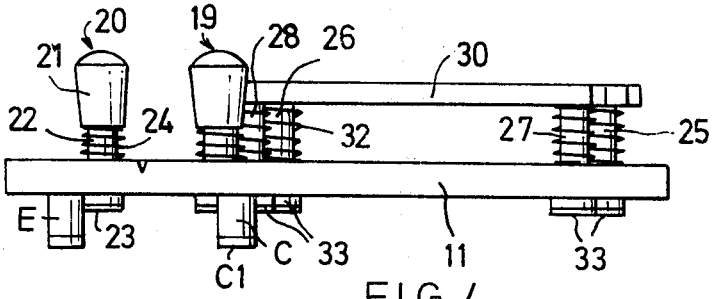
FIG. 4 is a view in elevation of the device shown in FIGS. 2 and 3.

Referring to the drawings, the device comprises a base plate 11 made of a plastics or other suitable material, such as that known under the Registered Trade Mark "Perspex". This may be about 6mm thick and of a width to fit over the strings and the finger board 12 of the guitar. The guitar nut is shown at 13 and some of the frets at 14 to 18. The strings have their conventional numbering 1 to 6.

Protruding from the underside of the plate 11 are four fixed pegs or support stops C, D, E and F, which may be made of a similar material to the plate 11 and which are fixed securely to it by an adhesive or by other means (e.g. screws). Each of these support stops C to F has a pad, such as Cl, of rubber or other suitable material fixed to its lower end, where it engages the finger board 12 or one of the strings, as will be described.

The device also has a number of individually operable keys 19 (also marked K3 to indicate "Key 3") and 20 (K4) which can be pressed against the strings by the player. Each of these keys has a head, such as 21, for engagement by a finger of the player, a shank, such as 22, which passes slidably through a hole in the plate 11, a pad, such as 23, of rubber, felt or other suitable material at its lower end, for engagement with a string, and a spring, such as 24, which surrounds the stem and normally keeps the pad clear of the string, unless the key is pressed.

The device also comprises two pairs of keys 25, 26 and 27, 28, the keys of each pair being connected by a bar 29 or 30. These keys 25 to 28 are secured to the bars 29 and 30 by means which will allow some angular movement of the key pegs relatively to the bars, in order to prevent wedging and allow one key only of a pair to be depressed when required. According to one method a rubber disc is interposed between the end of each key and its bar and is secured to both by an adhesive. In another method the keys are tubular, each with a rubber tube fitted inside it, and a screw (not shown) is screwed into its upper end.

Figure 6:
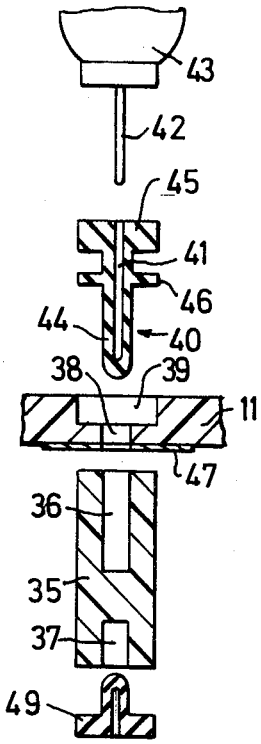
FIGS. 6 and 7 are detail sectional views showing a method of connecting together parts of the device.
Figure 7:
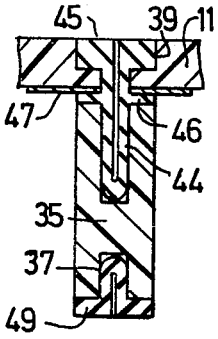
Figure 5:
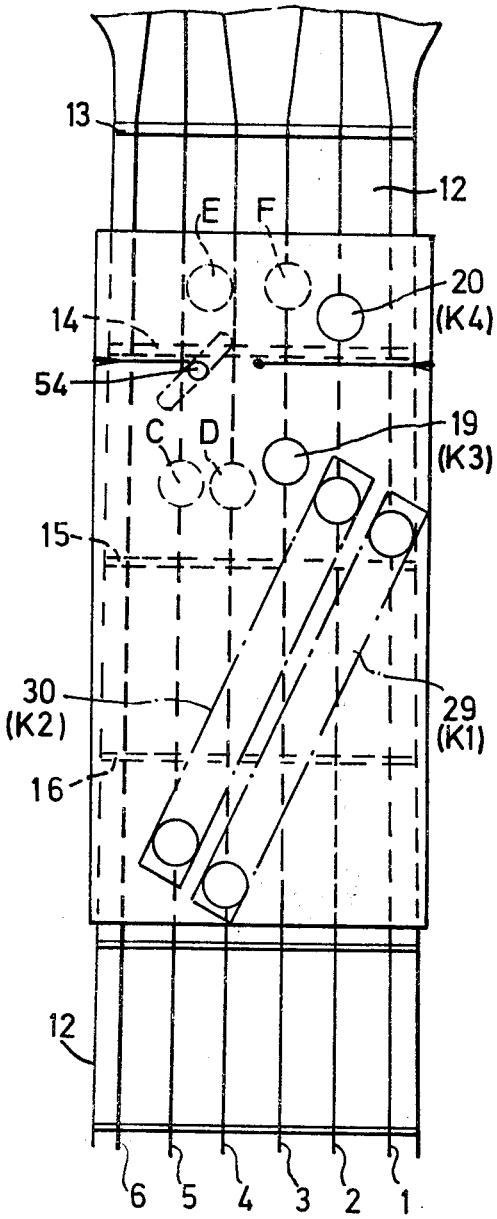
FIG. 5 is a partly diagrammatic view to help illustrate the construction and working of the device.

Another preferred form of attachment is shown in FIGS. 6 and 7.

A key, shown at 35, is moulded so that it has holes 36 and 37 extending from its ends, while the bar 29 is formed with a hole 38 having a recess 39 to receive a plug 40 made of rubber or like material. This plug, which is formed with a central hole 41 to receive the stem 42 of a suitable tool 43, has a shank 44, head 45 and collar 46. The bar 29 is shown with a disc 47 of felt or the like stuck to its under surface around the hole 38.

To fit the key 35 to the bar 29 the plug 40 is pressed by means of the tool 43 until both the shank 44 and collar 46 have passed through the hole 38. The key 35 is then pressed on to the shank 44, on which it is a press fit, until the parts occupy the positions shown in FIG. 7.

The keys 25 to 28 all have springs 32 and, at their lower ends, pads 33 made of felt or rubber which engage the strings 1 to 6; like the pads 23, these are of a sufficient diameter to prevent them from passing through the holes in the bar 29 so that they limit the movement of the keys.

The pads 33 may be stuck on the ends of the keys, or pads such as the one shown at 49 in FIGS. 6 and 7 may be used. Such a pad is made of rubber or the like and is fitted to the key in a similar way and using a similar tool as were used for the plug 40.

In all cases the holes in the plate 11 through which the keys 19, 20 and 25 to 28 pass are preferably lined with felt to prevent vibration.

The device is fitted to the guitar as shown in FIG. 1, where it is secured by suitable means. In the construction shown these means comprise a cord 51 made of nylon or other suitable material, one end of which is secured at 52 to the plate 11 and the other end of which carries a peg 53 which is inserted into a socket 54 in the base 11 and turned to tighten the cord.

To use the device the guitar is first tuned in the usual manner, after which the device is fitted as shown. To give an example, if the strings 1 to 6 are tuned to top E, B, G, D, A and base E, when the device is fitted:

Stop C will press the A string 5 on 2nd fret 15, causing the plucked string to sound B;

Stop D will press the D string 4 on 2nd fret 15, causing the plucked string to sound E;

Stop F will press the G string 3 on 1st fret 14, causing the plucked string to sound G # .

The stop E will rest behind the 1st fret 14 and between the strings 5 and 4 to prevent the device rocking on the finger board.

Sounding the strings of a conventionally tuned guitar with the device clamped to the finger board will thus sound the following notes: Bass E, B, middle E, G # , B, top E. The keys 19 and 20 can, however, be pressed individually against their strings, while the keys 25, 26 and 27, 28 of the pairs may be operated together by pressing one finger on the middle of the bar 29 or 30, which bars are also marked K1 and K2 as they are designated keys 1 and 2 respectively, or any of keys 25–28 can be pressed by itself.

It will thus be seen that:

Pressure on key 20("K4")will press the B string on to the fret 14 so that it will sound C when plucked;

Pressure on the key 19 ("K3") will press the G string onto the fret 15 so that it will sound A;

Pressure on the bar 30 (also marked K2 to designate "key 2") will cause its keys to press on two strings, the B string which will be pressed on to the fret 15 so that it will sound C # when plucked, and the A string which will be pressed onto the fret 17 so that when plucked it will sound C # the octave below.

Pressure on the bar 29 ("K1") will, in a similar manner act to cause the top E string to sound F # and the D string to sound F # an octave below.

Figure 9:
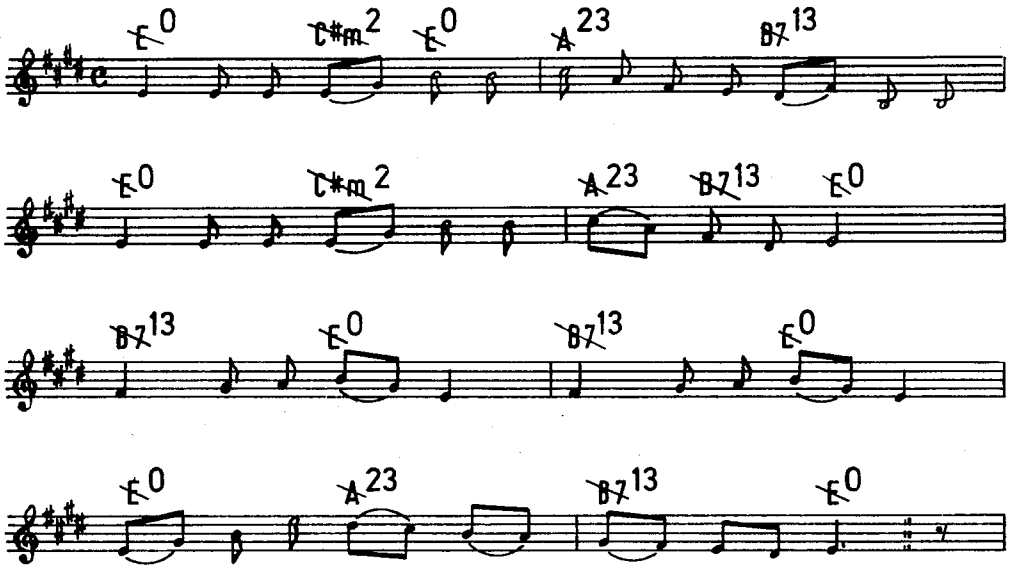

The device of the invention thus greatly facilitates the playing of certain kinds of music on the guitar or the like instruments and it also makes it easier for unskilled persons to read the music, which can be easily marked for this purpose. FIGS. 8 and 9 illustrate how the numbers 1 to 4 can be used to indicate which of the keys K1 to K4 should be operated (0 indicating no key).

It will be seen that, when the device is fixed to a guitar in the position shown in the drawings, pressing none, one or several keys K1 to K4 will produce chords and notes based on the musical key E major or C # minor when selected strings are plucked. If the device is repositioned by placing it one fret higher up the finger board and a "CAPOTASTO" clamper is fitted in the 1st fret position, the device will produce chords and notes based on the key F major or D minor.

Similarly, chords in two or three higher musical keys may be produced by moving the device and CAPOTASTO progressively up the finger board. However, since the positions of the keys relative to each other are fixed, whereas the distances between guitar frets become progressively narrower as they go higher up the guitar, there is a limit to how many fret positions a device can be moved to operate effectively.

A separately fabricated device which has slightly different dimensions between the keys but which is in other respects similar, would operate in the higher region of the finger board and could be provided for this purpose.

The invention by virtue of the arrangement of the coupled and individual keys and stops, including both the fixed and movable ones, especially the arrangement described and shown in the drawings, makes it possible for a wide range of musically related chords or notes to be played using a simple and easily playable device which has itself only got a small number of keys which need to be operated.

I claim:

1. A device for use when playing a stringed instrument comprising a base adapted to be fitted to said instrument so as to extend over at least some of the strings thereof, a plurality of manually-operable keys movably carried by said base in positions to engage strings of said instrument when said device is in position thereon, means biasing said keys out of engagement with said strings, at least one cross-bar extending between a pair of said keys, and means flexibly connecting each of said keys of said pair with said cross-bar so that either one of the keys of said pair can be pressed against its respective string without operation of the other key of said pair, and said cross-bar may be operated to press both keys connected therewith against their corresponding strings for the playing of a chord.

2. A device according to claim 1 which includes at least two of said cross-bars, each carrying a pair of said keys, and also a plurality of separate spring-biased keys adapted to be pressed individually against a string of said instrument.

3. A device according to claim 1 for use on an instrument having at least 5 strings and having frets against which said strings are pressed when playing, said device having:

a first cross-bar carrying a pair of keys adapted when operated to press the first string against the second fret and the fourth string against the fourth fret;

a second cross-bar carrying a pair of keys adapted when operated to press the second string against the second fret and the fifth string against the fourth fret;

a first single key adapted when operated to press the third string against the second fret;

a second single key adapted when operated to press the second string against the first fret; and three fixed stops fixed to said base in positions such that when the device is fitted to the instrument these stops press the fourth and fifth strings on the second fret, and the third string on the first fret.

4. A device according to claim 1 in which each said flexible connecting means comprises a connecting element formed of a resilient material having parts which are press fits in holes formed in said key and in said cross-bar and which have between them a collar which separates the end of said key from said cross-bar.

5. A device according to claim 1 in which each said connecting member is formed with an axial hole to receive a tool used for fitting said key to said cross-bar.

6. A device according to claim 1, which includes two cross-bars each carrying a pair of said keys, said cross bars being substantially parallel to each other and being arranged to lie at acute angles with respect to said strings when said device is fitted to said instrument.

7. A device according to claim 1 which also includes at least one fixed stop, each said fixed stop being in position to engage one of said strings when said device is fitted to said instrument.

8. A device according to claim 1 which is provided with means for attaching it to said instrument comprising a flexible cord having one of its ends attached to said base plate, a peg attached to the other end of said cord and adapted to be fitted in a socket in said base plate and to be turned to tighten said cord around part of said instrument.

9. A device according to claim 1, having a pair of said cross-bars, each interconnecting a pair of said keys, with said flexibly connecting means attaching each said key to its respective cross-bar; a plurality of fixed stops adapted to engage strings of said instrument which are different to each other when said device is in position on said instrument and at least two individually-operable keys which are adapted to engage different ones of said strings when they are operated.

* * * * *